US006893090B1

(12) United States Patent
Van Deursen et al.

(10) Patent No.: US 6,893,090 B1
(45) Date of Patent: May 17, 2005

(54) COMBINATION OF A SEAT AND A BACKREST SUPPORTED BY A FRAME

(75) Inventors: Dirk Laurens Van Deursen, Gravenhage (NL); Leonardus Laurentius Joseph Maria Van Deursen, Bladel (NL)

(73) Assignee: Ergodynamics Holding, B.V., Bladel (NL)

( * ) Notice: Subject to any disclaimer, the term of this patent is extended or adjusted under 35 U.S.C. 154(b) by 0 days.

(21) Appl. No.: 10/110,044

(22) PCT Filed: Oct. 3, 2000

(86) PCT No.: PCT/NL00/00709

§ 371 (c)(1),
(2), (4) Date: Apr. 5, 2002

(87) PCT Pub. No.: WO01/26508

PCT Pub. Date: Apr. 19, 2001

(30) Foreign Application Priority Data

Oct. 8, 1999 (NL) ..... 1013253

(51) Int. Cl.[7] ..... A47C 1/031
(52) U.S. Cl. ..... 297/312; 297/316; 297/340; 297/344.22; 297/353
(58) Field of Search ..... 297/312, 314, 297/313, 353, 284.6, 316, 337, 340, 344.226

(56) References Cited

U.S. PATENT DOCUMENTS

| | | | | | |
|---|---|---|---|---|---|
| 1,976,326 | A | * | 10/1934 | Carlton | 297/312 X |
| 2,492,671 | A | | 12/1949 | Wettlaufer | |
| 4,429,918 | A | * | 2/1984 | Alsup et al. | 297/353 |
| 4,826,247 | A | * | 5/1989 | McGrady et al. | 297/314 X |
| 4,860,733 | A | | 8/1989 | Parker, Jr. | |
| 5,022,385 | A | | 6/1991 | Harza | |
| 5,695,250 | A | * | 12/1997 | Lin | 297/353 X |
| 5,713,632 | A | | 2/1998 | Su | |
| 5,967,610 | A | * | 10/1999 | Lin | 297/340 X |
| 6,074,006 | A | * | 6/2000 | Milosic et al. | 297/284.6 |
| 6,139,095 | A | | 10/2000 | Robertshaw | |
| 6,203,107 | B1 | * | 3/2001 | Jonsson | 297/337 X |

FOREIGN PATENT DOCUMENTS

| | | |
|---|---|---|
| EP | 0 574 071 B1 | 12/1993 |
| EP | 0 574 073 A1 | 12/1993 |

* cited by examiner

*Primary Examiner*—Anthony D. Barfield
(74) *Attorney, Agent, or Firm*—Banner & Witcoff, Ltd.

(57) ABSTRACT

The present invention relates to a combination of a seat and a backrest supported by a frame, wherein said combination includes means for effecting movement of the seat with respect to the backrest, in such a manner that a person sitting on said seat is subjected to a reciprocating pivoting movement about a substantially vertical axis. The seat comprises two parts, which parts are arranged on either side of a vertical plane that extends at least substantially transversely to the backrest. Means are provided for moving said seat parts to and fro in directions opposed to each other.

13 Claims, 5 Drawing Sheets

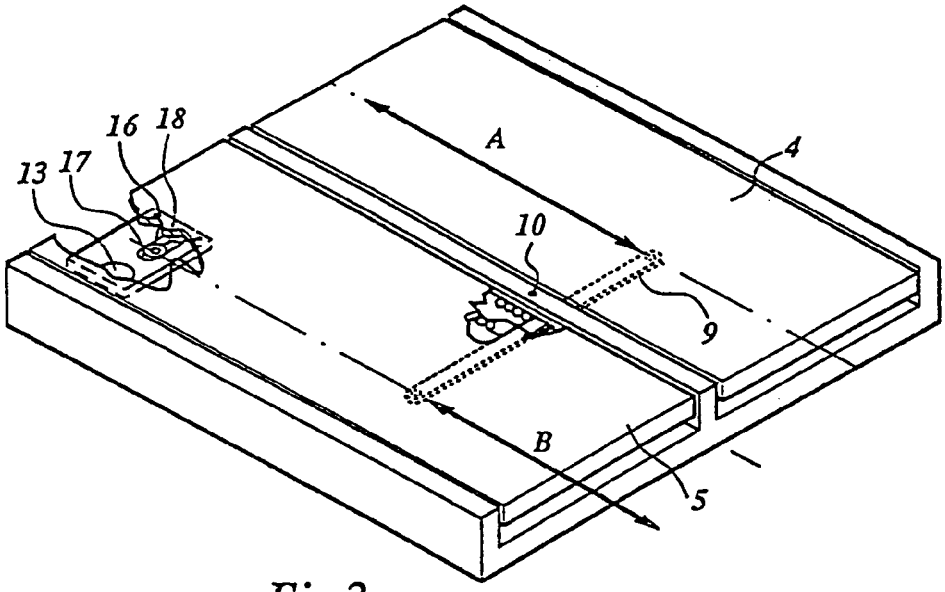
Fig.2
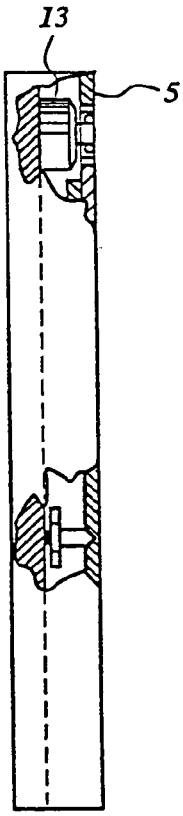
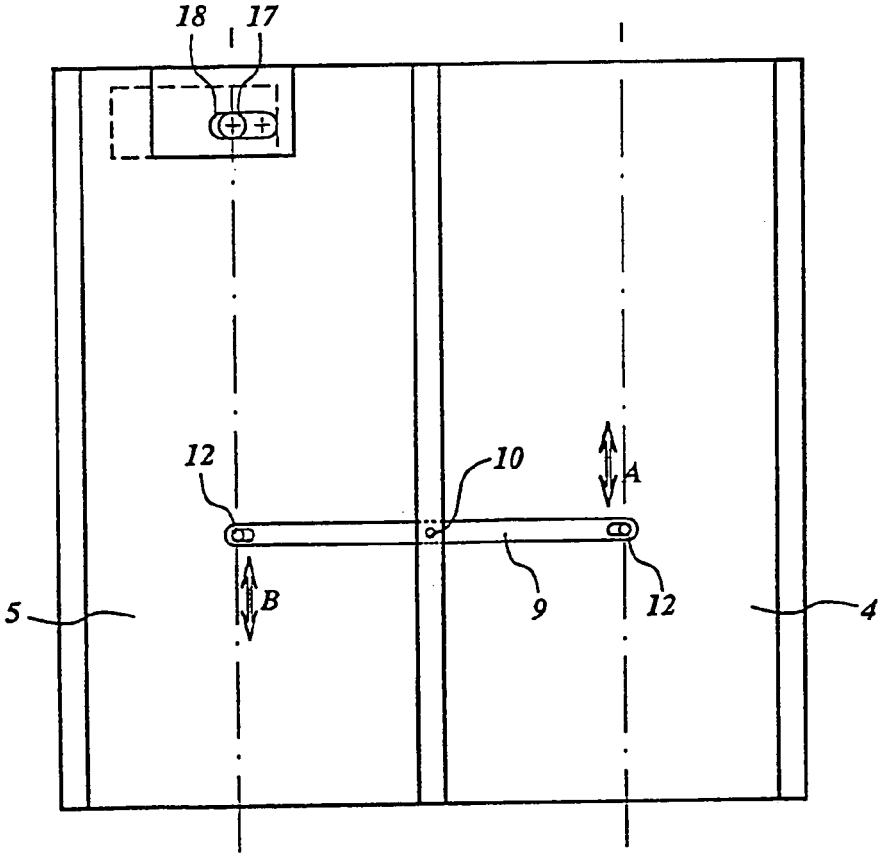
Fig.4
Fig.3

COMBINATION OF A SEAT AND A BACKREST SUPPORTED BY A FRAME

The invention relates to a combination of a seat and a backrest supported by a frame, wherein the seat comprises two parts, which parts are arranged on either side of a vertical plane that extends at least substantially transversely to the backrest and said combination further includes means for effecting movement of said two parts of the seat with respect to the backrest.

A combination of this kind is known from U.S. Pat. No. 5,713,632. In said known combination the two seat parts are adjustable in a direction perpendicular to said vertical plane, whereby during normal use of the combination said two parts of the seat have a fixed position with respect to the backrest.

In a prior art combination according EP-A-0574073 the seat, which is in one piece, is supported by a shaft, which forms an axis about which the seat can pivot to and fro.

Said combination is satisfactory per se, but in some cases, particularly in those cases where the seat is loaded heavily or where there is insufficient room for the seat to move, the construction according to EP-B-0574073 may be difficult to realise.

According to the invention means are provided means for driving said seat parts to and fro in directions opposed to each other and substantially parallel to said vertical plane.

A person sitting on such a seat will be pivoted about an imaginary upwardly extending pivot axis in a similar manner as is the case with the prior art construction according EP-A-0574073 when the seat parts are driven. The seat parts that move to and fro in a straight line can be supported in a simple and solid manner thereby, so that the combination will also be able to withstand heavy loads, without additional space being required towards the, sides, whilst using a relatively simple and inexpensive construction of the combination.

In U.S. Pat. No. 6,139,095 (filing date Dec. 31, 1998, publication date Oct. 31, 2000) there has been described a combination of a seat and a backrest wherein two seat parts arranged on either side of a vertical plane that extends substantially transversely to the backrest are pivotable about axes extending perpendicular to said vertical plane.

Another aspect of the invention relates to a combination of a seat and a backrest supported by a frame which is pivotable about an upwardly extending pivot axis, wherein said combination includes means for effecting movement of the seat with respect to the backrest, in such a manner that a person sitting on said seat is subjected to a reciprocating pivoting movement about a substantially vertically extending pivot axis, as known from European patent no. 0574073.

According to the invention, means are provided near the lower end of the backrest for exerting forces on a person sitting on said seat, in such a manner that the person sitting on the seat is pivoted to and fro along with the seat about said upwardly extending pivot axis.

A solution of this kind is for example very suitable in those cases where a minimal overall height of the seat is important.

The invention will now be explained in more detail by means of an embodiment of the construction according to the invention which is schematically illustrated in the accompanying figures.

FIG. 2 is a schematic, perspective view of the arrangement of two seat parts.

FIG. 3 is a top plan view of the seat parts of FIG. 2.

FIG. 4 is a side view, partially in section, of FIG. 3.

Figure 1:
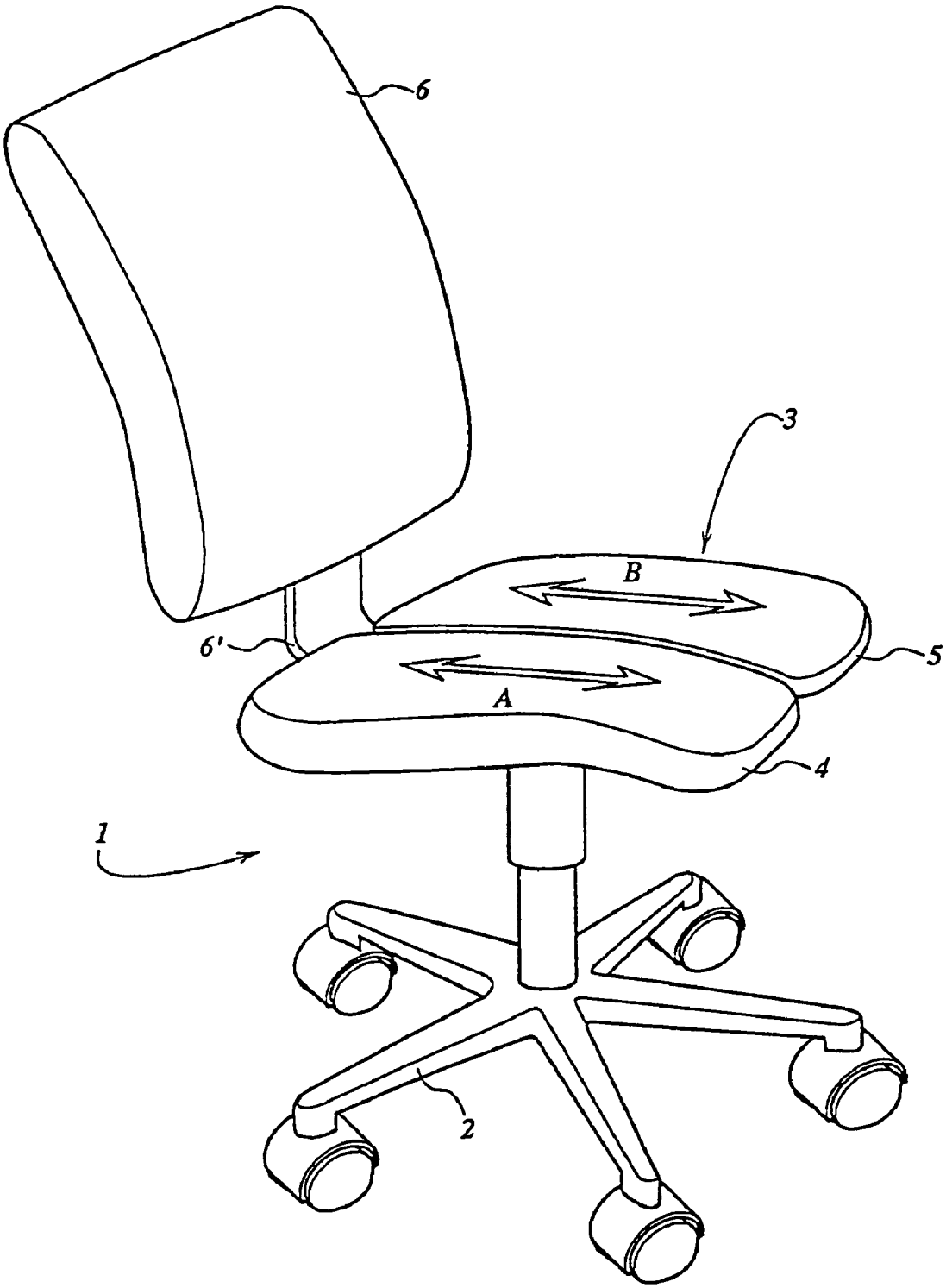
FIG. 1 is a schematic, perspective view of a combination according to the invention in the form of a chair.
Figure 5:
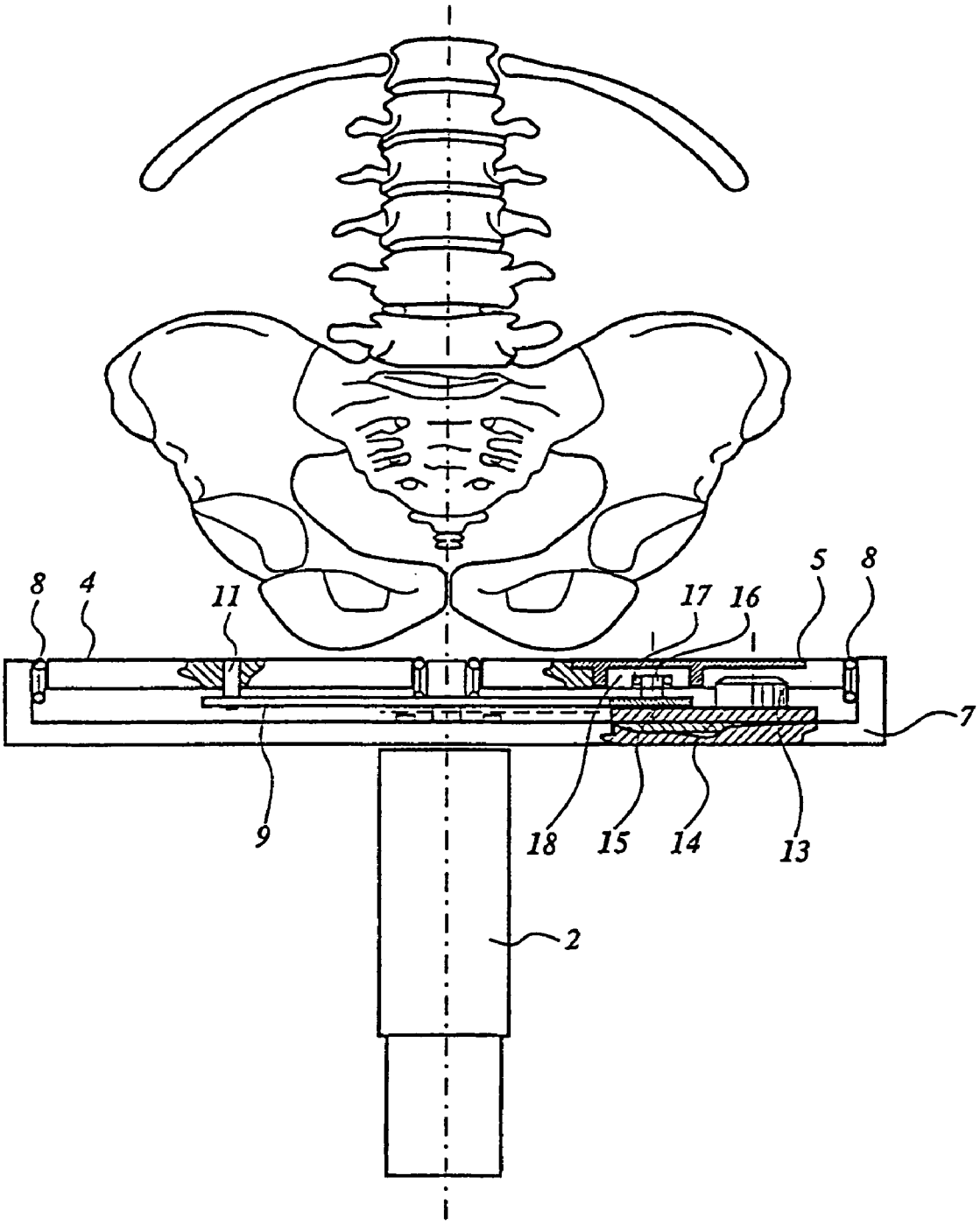
FIG. 5 is a front view, partially in section, of seat parts arranged one beside another.

The combination that is shown in FIG. 1 is made up of a conventional chair 1, which is provided with a wheel-supported frame 2, which supports a seat 3 comprising two parts 4 and 5 positioned one beside another. Furthermore a backrest 6 is attached to frame 2 by means of an arm 6'.

The two seat parts 4 and 5 are disposed on either side of a plane of symmetry that extends vertically and at least substantially transversely, that is, at least substantially perpendicularly, seen in top plan view, to the backrest 6.

As is shown in more detail in FIGS. 2–5, the two seat parts 4 and 5 can be supported by a supporting member 7 attached to the upper end of frame part 2. Seat parts 4 and 5 are thereby supported in said supporting member by means of ball tracks 8 or roller bearings or the like mounted on the sides of seat parts 4 and 5, in such a manner that the two seat parts 4 and 5 can be moved to and fro in their longitudinal direction as indicated by double arrows A and B.

As is furthermore shown in the figures, the two seat parts 4 and 5 are interconnected by means of a coupling rod 9. Said coupling rod 9 is coupled to supporting member 7 by means of a vertical shaft 10, which is disposed near the dividing line between the two seat parts 4 and 5. The ends of coupling rod 9 are pivotally connected to seat parts 4 and 5, respectively, by means of pins 11 extending parallel to shaft 10. Said pins 11 are thereby disposed in slotted holes 12 formed in said seat parts.

Mounted under seat part 5 is an electric motor 13, which is supported by supporting member 7, which motor is coupled, by means of a chain or belt transmission 14, to a chain wheel or pulley 15, which is rotatable about a vertical shaft that is attached to supporting member 7. Attached to chain wheel or pulley 15 is an upwardly extending stud 16, whose central axis is disposed eccentrically with respect to the central axis or axis of rotation of wheel 15. Said stud 16 is surrounded at its upper end by a bearing 17, which is disposed in a recess 18 formed in seat part 5, which recess extends transversely to the longitudinal direction of said seat part.

It is also possible to use a gear transmission instead of a chain or belt transmission.

It will be apparent that when the chair is being used and the electric motor 13 is activated, thus rotating the chain wheel, pulley or gear 15, the stud 16 that is connected to said chain wheel, pulley or gear 15 will make a circular movement about the axis of rotation of said chain wheel, pulley or gear 15. Since the upper end of stud 16 is disposed in recess 18 in seat part 5, said circular movement of stud 16 will effect a reciprocating translating movement of seat part 5 as indicated by arrow B, whereby the upper end of stud 16 will move to and fro in recess 18, in a direction transversely to the longitudinal direction of the seat part.

Since the seat part 5 is coupled to seat part 4 by means of coupling rod 9 in the above-described manner, also seat part 4 will be moved to and fro as indicated by arrow A, whereby seat part 4 will move in a direction opposed to the direction of movement of seat part 5. The stroke of the two seat parts in either direction will only be a few millimetres thereby.

It will be apparent that as a result of said reciprocating movement of the two seat parts 4 and 5, a person sitting on the two seat parts 4 and 5 will be subjected to a small pivoting movement about a vertical axis, in a similar manner as disclosed in the aforesaid European patent no. 0 574 071.

Of course additions and/or modifications to the above-described embodiment of the construction according to the invention are conceivable.

Thus the seat parts and the backrest can be supported in a different manner than by frame 2, for example, and they can be built into vehicles, aeroplanes or the like, for example.

Furthermore it will be possible to drive the seat parts in a different manner, for example by means of setting cylinders, electromagnets or the like. Possibly it will be conceivable to move several seats by means of one driving mechanism, for example in vehicles comprising several seats.

It will furthermore be apparent that the movable seat parts need not extend along the entire width and/or length of the seat, but may be limited to those parts of the seat by which the user's body will be mainly supported during normal use of the seat.

Figure 6:
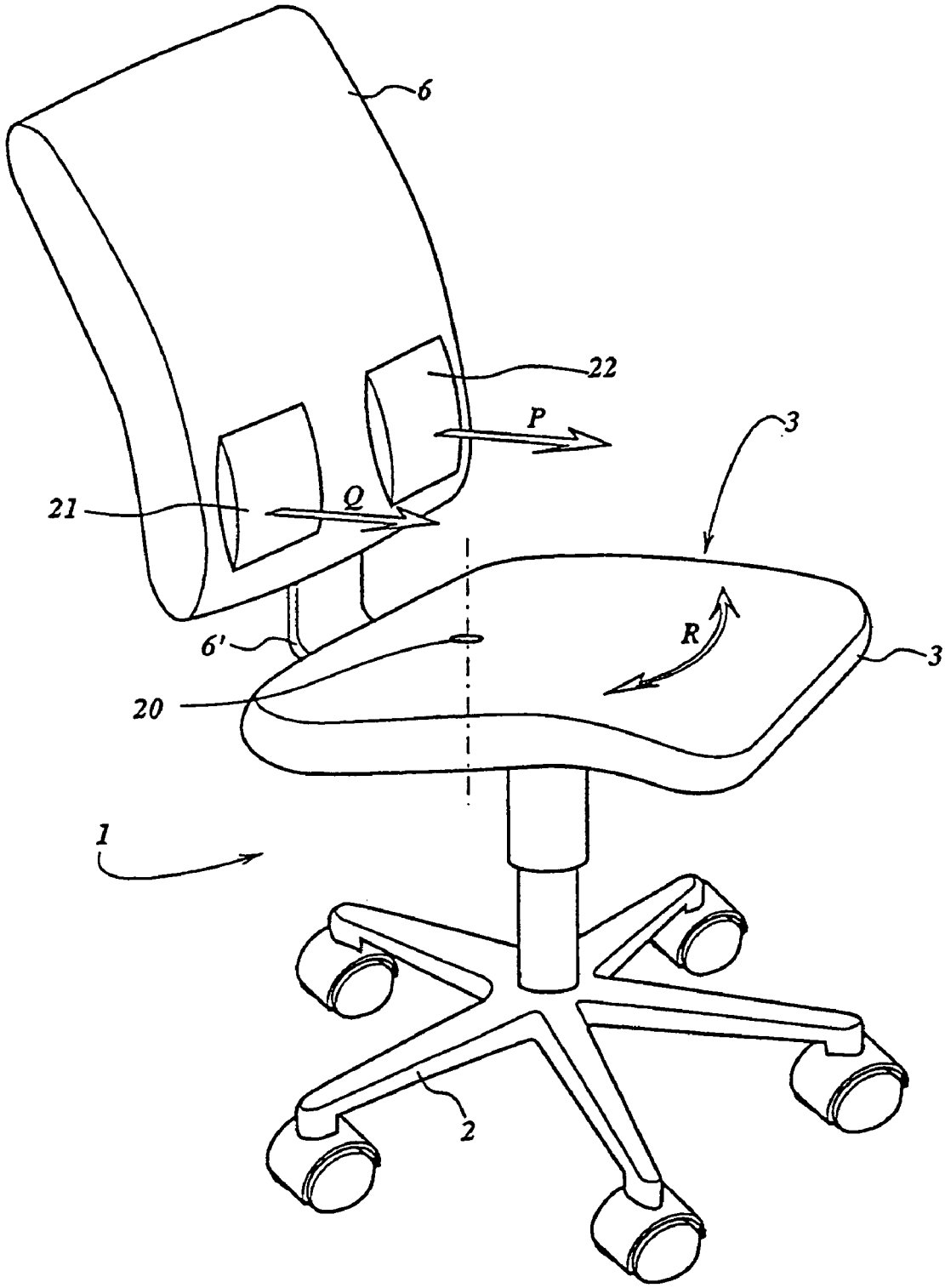
FIGS. 6 and 7 show further possible embodiments of a combination according to the invention.
Figure 7:
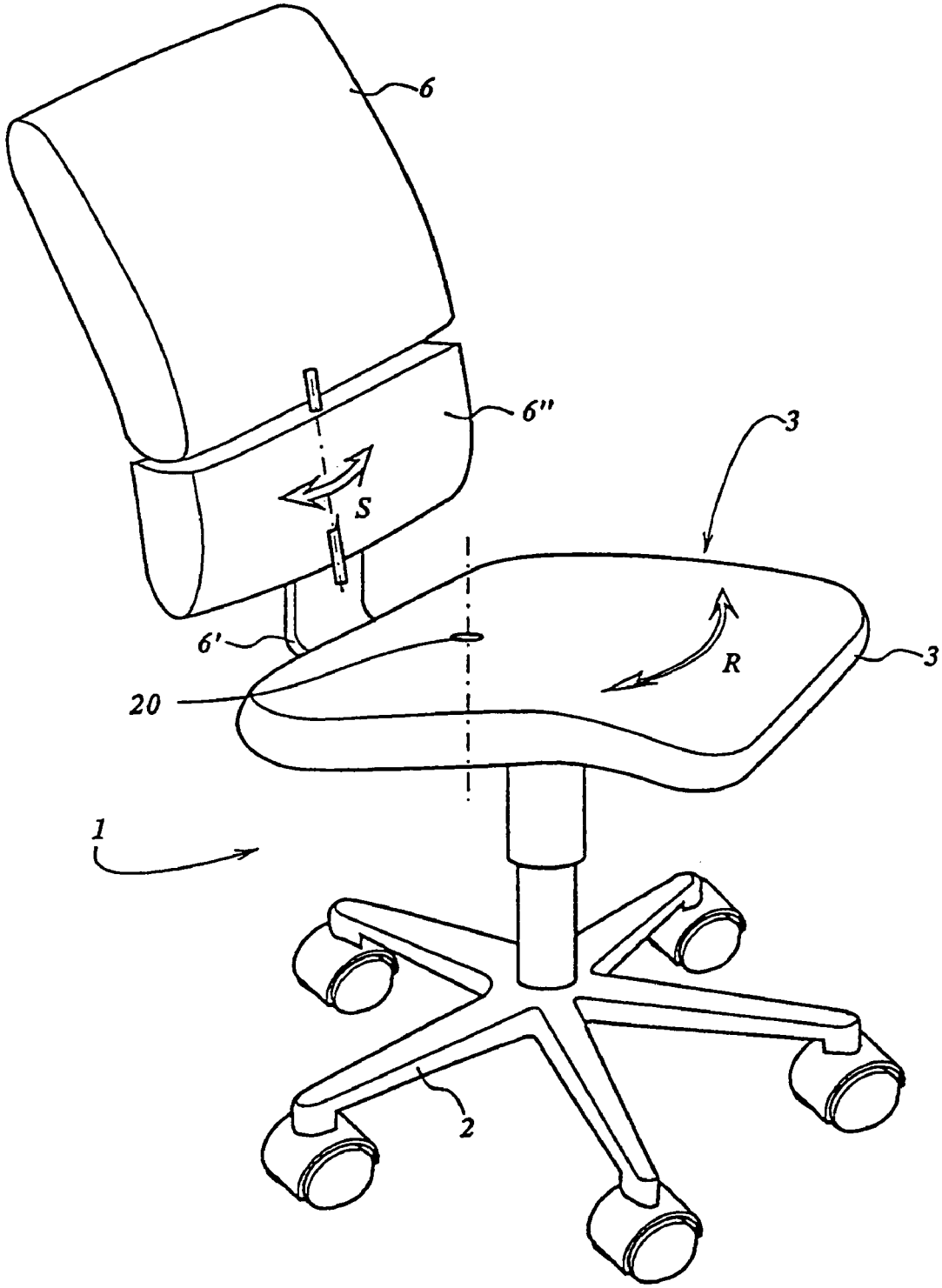

FIGS. 6 and 7 show two further embodiments of combinations according to the invention.

Parts that correspond to parts of the combination described with respect to FIGS. 1–5 are indicated by the same numerals as in FIGS. 1–5, those parts will not be discussed again.

In the embodiments according to FIGS. 6 and 7, however, seat 3 is conventionally made in one piece. In the two embodiments according to FIGS. 6 and 7 the seat is pivotable with respect to frame 2 about an upwardly extending, in particular vertical axis 20.

In the embodiment that is shown in FIG. 6, two inflatable elements 21 and 22 in the form of airbags, bellows or the like arranged one beside another are disposed in the lower part of backrest 2.

Said elements 21 and 22 are adapted to expand when a pressurized fluid is supplied thereto, in such a manner that the boundary walls of elements 21 and 22 facing towards the seat will move in the direction of seat 3, whilst the boundary walls of elements 21 and 22 facing towards the seat will move in a direction away from seat 3 when fluid is discharged from said elements 21 and 22, either under the influence of their own resilience or of built-in spring means, or as a result of an sub-atmospheric pressure being generated in said elements 21 and 22.

When using the combination shown in FIG. 6, a pressurized fluid, generally a gas such as air, although it will also be possible to use a liquid, will be admitted alternately into one of said elements 21 or 22, whilst at the same time fluid will be discharged from the other element. It will be apparent that consequently a force in the direction indicated by arrow P and a force in the direction indicated by arrow Q will be alternatively exerted on the lower part of the back of a person sitting on seat 3, as a result of which seat 3 will be pivoted to and fro about axis 20, as indicated by means of arrow R. It will be apparent that thus a similar effect is achieved as described above.

A variation on this embodiment is shown in FIG. 7, wherein a lower part 6" of backrest 6 can be moved to and fro (by means not shown) about an upwardly extending axis 23, as indicated by arrow S.

It will be apparent that also in this embodiment a pushing force can be exerted on the lower part of the back of a person sitting on seat 3, alternately near the left-hand side and near the right-hand side of the user's body, so that a reciprocating pivoting movement about the upwardly extending axis 20 will be imparted to the user and to the seat.

Furthermore it will be apparent that it is possible with the various embodiments described herein to vary the open angle between the backrest and the seat parts, for example by pivoting the backrest forwards and/or backwards about an axis located near the seat parts.

What is claimed is:

1. A combination of a seat and a backrest supported by a frame, wherein said combination includes means for effecting movement of the seat with respect to the backrest, in such a manner that a person sitting on said seat is subjected to a reciprocating pivoting movement about a substantially vertical axis, wherein the seat comprises two parts, which parts are arranged on either side of a vertical plane that extends at least substantially transversely to the backrest, and wherein means are provided for moving said seat parts to and fro in directions opposed to each other and substantially transverse to the backrest, wherein the two parts are moved in reciprocating fashion at the same time.

2. A combination according to claim 1, characterized in that said seat parts are interconnected by means of a coupling rod, which is pivotable near the dividing line between the seat parts about a vertical axis, whilst a lever is coupled to the seat parts by means of axes extending parallel to said vertical pivot axis.

3. A combination according to claim 1, characterised in that both seat parts are supported in a supporting member by means of ball bearings or roller bearings.

4. A combination according to claim 1, characterised in that one seat part is driven by means of a motor via an eccentric mechanism.

5. A combination of a seat and a backrest supported by a frame which is pivotable about an upwardly extending pivot axis, wherein said combination includes means for effecting movement of the seat with respect to the backrest, in such a manner that a person sitting on said seat is subjected to a reciprocating pivoting movement about a substantially vertically extending pivot axis, wherein means are provided near a lower end of the backrest for moving at least a portion of a lower part of the backrest with respect to an upper part of the backrest and exerting forces in a direction substantially transverse to the backrest on a person sitting on said seat, in such a manner that the person sitting on the seat is reciprocatingly pivoted to and fro along with the seat about said upwardly extending pivot axis.

6. A combination of a seat and a backrest supported by a frame which is pivotable about an upwardly extending pivot axis, wherein said combination includes means for effecting movement of the seat with respect to the backrest, in such a manner that a person sitting on said seat is subjected to a reciprocating pivoting movement about a substantially vertically extending pivot axis, wherein means are provided near a lower end of the backrest for exerting forces in a direction substantially transverse to the backrest on a person sitting on said seat, in such a manner that the person sitting on the seat is reciprocatingly pivoted to and fro along with the seat about said upwardly extending pivot axis, characterized in that two elements arranged one beside another are provided near the lower end of the backrest, to which elements a pressurized fluid can be supplied, with boundary edges of said elements that face towards the seat being movable in such a manner that a movable boundary wall will move in the direction of said seat when a pressurized fluid is supplied and that the movable boundary wall will move back again when the pressure is released, and in that means are provided for alternately supplying a pressurized fluid to one element and to the other.

7. A combination according to claim 5, characterized in that said lower part of the backrest is pivotable about the upwardly extending axis, and in that means are provided for imparting a reciprocating pivoting movement to said lower part of the backrest.

8. A combination according to claim 2, characterized in that both seat parts are supported in a supporting member by means of ball bearings or roller bearings.

9. A combination according to claim 2, characterized in that one seat part is driven by means of a motor via an eccentric mechanism.

10. A combination according to claim 3, characterized in that one seat part is driven by means of a motor via an eccentric mechanism.

11. A combination according to claim 1, wherein the two seat parts are moved by a coupling rod, which is connected to the two seat parts and is pivotable near the dividing line between the seat parts about a vertical axis.

12. A combination according to claim 5, wherein the forces are exerted in a substantially horizontal direction, transverse to the backrest.

13. A combination according to claim 5, wherein the seat is rotated independently from the backrest about said upwardly extending pivot axis by said exerting forces.

* * * * *